United States Patent [19]

LaPierre et al.

[11] Patent Number: 4,541,919

[45] Date of Patent: Sep. 17, 1985

[54] SHAPE SELECTIVE DEWAXING USING COKE MODIFIED LARGE PORE ZEOLITES

[75] Inventors: Rene B. LaPierre, Medford; Randall D. Partridge, Princeton, both of N.J.

[73] Assignee: Mobil Oil Corporation, New York, N.Y.

[21] Appl. No.: 638,608

[22] Filed: Aug. 7, 1984

[51] Int. Cl.[4] ..... C10G 47/20

[52] U.S. Cl. ..... 208/111; 502/64; 502/66

[58] Field of Search ..... 208/50, 51, 53, 54, 208/55, 111; 502/64, 66

[56] References Cited

U.S. PATENT DOCUMENTS

| | | | |
|---|---|---|---|
| 3,684,691 | 8/1972 | Arey et al. | 208/111 |
| 3,923,635 | 12/1975 | Schulman et al. | 208/50 |
| 3,988,260 | 10/1976 | Weber et al. | 208/111 |
| 4,080,284 | 3/1978 | Mitchell | 208/120 |
| 4,090,981 | 3/1978 | Rodewald | 502/69 |
| 4,097,543 | 6/1978 | Haag et al. | 585/475 |
| 4,231,899 | 11/1980 | Chen et al. | 502/86 |
| 4,269,696 | 5/1981 | Metrailer | 208/53 |
| 4,316,794 | 2/1982 | Schoennagel | 208/111 |
| 4,358,366 | 11/1982 | Alford et al. | 208/50 |
| 4,390,414 | 6/1983 | Cody | 502/85 |
| 4,394,250 | 7/1983 | Grossberg | 208/50 |
| 4,419,220 | 12/1983 | LaPierre et al. | 208/111 |
| 4,421,634 | 12/1983 | Olavesen | 208/111 |
| 4,429,053 | 1/1984 | Ward | 208/111 |
| 4,435,279 | 3/1984 | Busch et al. | 208/111 |
| 4,440,629 | 4/1984 | Stine | 208/111 |
| 4,451,572 | 5/1984 | Cody | 502/62 |

*Primary Examiner*—D. E. Gantz
*Assistant Examiner*—Anthony McFarlane
*Attorney, Agent, or Firm*—Alexander J. McKillop; Michael G. Gilman; Marinaa V. Schneller

[57] ABSTRACT

A large pore zeolite is selectively coked to restrict the zeolite's pore size. The coked zeolite is used for shape selective dewaxing.

14 Claims, No Drawings

SHAPE SELECTIVE DEWAXING USING COKE MODIFIED LARGE PORE ZEOLITES

BACKGROUND OF THE INVENTION

1. Field of the Invention

This invention relates to a process for dewaxing of heavy oils using a large pore zeolite which has been modified by coke deposition.

2. Description of Relevant Art

Selective dewaxing of hydrocarbon oils, both for pour point improvement and for preparation of lubricating oil base stocks, is well-known.

Much work has been done on catalytic hydrodewaxing using shape selective zeolites.

The ideal hydrodewaxing catalyst should have several necessary chemical and physical features.

The zeolite should have a pore size which is large enough to admit waxy paraffins and slightly branched paraffins but small enough to exclude, or diffuse only slowly, "non-paraffinic" oil molecules. The relative rates of diffusion of waxy and non-waxy components should be sufficiently different so as to favor selective conversion of the waxy paraffinic molecules.

Some zeolites stand out for hydrodewaxing and many other hydroconversion processes; these are the shape selective zeolites, such as ZSM-5 (U.S. Pat. No. 3,702,886). ZSM-5 has a highly stable framework containing two types of intersecting channels which have ten-membered ring openings. These are therefore intermediate between those of classical shape-selective zeolites with 8 membered rings (zeolite A, erionite) and the larger pore 12 membered ring zeolites (faujasite, X, Y, mordenite and fault free offretite).

ZSM-5 has two sets of channels, in one direction the channels are sinusoidal with near circular openings of about 0.55 nm. The other channels are straight with elliptical cross section (0.52–0.58 nm) Nature 272, 437 (1978). Further the zeolite can be crystallized with very high $SiO_2$ contents giving it hydrophobic properties. ZSM-5 has a Constraint Index, as hereafter defined, of about 8.

Some work has been done on modifying the diffusivity characteristics of zeolites with a Constraint Index of 1 to 12. U.S. Pat. No. 4,117,026, the entire contents of which are incorporated herein by reference, discloses one such process. The shape selective zeolites are modified by combining therewith a small amount, generally 2 to 30 weight percent, of a difficultly reducible oxide, such as oxides of antimony, boron, etc. Modification of the zeolite by precoking to deposit at least one weight percent of coke is disclosed.

U.S. Pat. No. 4,097,543, the entire contents of which are incorporated herein by reference, discloses controlled precoking of shape selective zeolites, i.e., those having a Constraint Index of 1 to 12. The catalyst is used for selective production of paraxylene by disproportionation of toluene.

Closely related to, and an improvement upon, the teachings of U.S. Pat. No. 4,097,543 and U.S. Pat. No. 4,117,026 is application Ser. No. 524,626, assigned to the same assignee. This application discloses carefully controlled coking of a zeolite with a Constraint Index of 1–12.

Large pore zeolites having a Constraint Index less than 1, are generally regarded as not being shape selective, although both mordenite and offretite are selective enough for certain hydrodewaxing operations. Typical large pore zeolites unsuitable for dewaxing are X and Y, and structurally related zeolites such as ZSM-3 and ZSM-20.

Zeolite Y is one of the largest known 12 ring zeolites and is used in hydrocracking applications where hydrocarbon molecules of various types and shapes are converted. One useful feature of this type of zeolite is that it possesses the structure of the rare mineral faujasite. It has a 3 dimensional network of openings connecting supercages. This open structure is characterized by the zeolite's high capacity for the sorption of hydrocarbons such as cyclohexane, i.e. $>10$ wt. % at 25° C.

Zeolite X is another large, and well-known faujasite type zeolite. Zeolite X is a known hydrocracking catalyst, typically used in a rare earth exchanged form and contained in amorphous binder, typically with hydrogenation/dehydrogenation components added.

Some work has been done on modifying the characteristics of certain large pore zeolites (mordenite, offretite and zeolite Y) by silylation, as noted in U.S. Pat. No. 4,390,414, the entire contents of which are incorporated herein by reference. This patent includes a discussion of prior art silylation work.

U.S. Pat. No. 4,231,899, the entire contents of which are incorporated herein by reference, teaches stabilizing intermediate pore sized zeolites against steam deactivation by coking the zeolite. It was recognized that the coked zeolite had a reduced sorption capacity, indicating that some carbonaceous residue was within the zeolitic pores. The coking process was useful for adding steam stability to zeolites, such as ZSM-5, ZSM-11, ZSM-12. This reference taught that materials such as erionite, mordenite and faujasite, having a higher constraint index (or larger pore size) than ZSM-5 may also be subjected to coking to impart steam stability. No examples of coking of large pore zeolites were provided. The thrust of the invention was to develop a zeolite which would be steam stable, i.e., one which would withstand the large amounts of steam encountered in converting methanol to hydrocarbon products. Intermediate pore zeolites, such as ZSM-5, are used in such processes rather than large pore zeolites.

There was no indication as to the effect of the coke deposited upon the zeolites' shape selectivity. A loss of sorption capacity due to coking was noted, however the effect of coke on hydrophobicity is not mentioned.

A certain amount of coke deposition gradually occurs in conventional hydrocracking processes. In general, coke deposition in hydrocracking is avoided. Coke deposition covers up active sites upon the catalysts. This phenomenon was also recognized in the previously discussed U.S. Pat. No. 4,231,899, which taught that coke covered sites are not catalytically active until the coke is removed.

Accordingly the art has generally considered coke deposition as something to be avoided, and taught that when it does occur catalytically active sites covered by the coke are rendered inactive.

We discovered that is was possible, by coke deposition in the pores of a large pore zeolite with cyclohexane sorption capacity of $>10\%$, to produce a zeolite which exhibited shape selectivity, i.e., which behaved as if it had a smaller pore size, equivalent to a constraint index greater than one. There was some loss of catalytic activity, but careful control of the large pore zeolite starting material, and coke deposition operating conditions, permitted shape selective catalytic dewaxing with a large pore zeolite.

SUMMARY OF THE INVENTION

Accordingly, the present invention provides a process for selectively dewaxing a waxy hydrocarbon oil feedstock and comprising contacting said feedstock in the presence of hydrogen at dewaxing conditions with a catalyst comprising a coked zeolite wherein said zeolite prior to coking has a Constraint Index less than 1 and a cyclohexane sorption capacity greater than 10% and has been subjected to coking with a coke precursor at coking conditions including a neutral, or reducing atmosphere, wherein the hydrogen partial pressure of said reducing atmosphere is less than about 60 atmospheres.

In another embodiment, the present invention provides a process for selectively dewaxing a waxy hydrocarbon oil feedstock comprising contacting said feedstock in the presence of hydrogen at dewaxing conditions with a catalyst comprising a coked large pore zeolite containing 10 to 60 wt. % coke, wherein said zeolite has been coked with a coke precursor at coking conditions wherein said coke is deposited on said zeolite within 0.1 to 200 hours.

In a more limited embodiment, the present invention provides a process for selectively dewaxing a waxy hydrocarbon oil feedstock comprising contacting said feedstock in the presence of hydrogen at dewaxing conditions with a coked large pore zeolite containing 15 to 30 wt. % coke wherein said zeolite has been subjected to coking with a coke precursor at coking conditions in an oxidizing, neutral, or reducing atmosphere wherein the hydrogen partial pressure of said reducing atmosphere is less than about 40 atmospheres, absolute, said coking is completed in from 0.01 to 100 hours.

Feedstocks

The waxy oils which can be processed in the present process range from relatively light distillates or heating oils through heavy lube stocks, bright stocks and even heavier stocks. Preferred stocks are distillate fuels boiling in the 200°–400° C. range, and vacuum gas oils boiling above about 350° C.

Zeolites

The zeolite which is surface modified may be any large pore natural or synthetic-molecular sieve zeolite such as zeolite X, zeolite Y, ZSM-3 and ZSM-20, zeolite Beta, with a sorption capacity for cyclohexane at room temperature of greater than 10% by weight.

The zeolites contemplated for use herein may also contain other elements such as Fe, B, Ga, as total or partial substitutes for aluminum.

For the purposes of the application, both natural and synthetic zeolites are contemplated.

Zeolite material embraced in this application will have a Constraint Index less than 1. These large pore zeolites are characterized by a pore opening greater than about 6–7 angstrom units.

The "Constraint Index" as herein defined may be determined by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature is adjusted between about 550° F. and 950° F. to give an overall conversion of between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to (total) hydrocarbon mole ratio of 4:1. After 20 minutes on stream, a sample of the effluent is taken and analyzed, most conveniently by gas chromatography, to determine the fraction remaining unchanged for each of the two hydrocarbons.

While the above experimental procedure will enable one to achieve the desired overall conversion of 10 to 60% for most zeolite samples and represents preferred conditions, it may occasionally be necessary to use somewhat more severe conditions for samples of very low activity, such as those having an exceptionally high silica to alumina mole ratio. In those instances, a temperature of up to about 1000° F. and a liquid hourly space velocity of less than one, such as 0.1 or less, can be employed in order to achieve a minimum total conversion of about 10%.

The "Constraint Index" is calculated as follows:

$$\text{Constraint Index} = \frac{\log_{10}(\text{fraction of hexane remaining})}{\log_{10}(\text{fraction of 3-methypentane remaining})}$$

The Constraint Index approximates the ratio of the cracking rate constants for the two hydrocarbons. Constraint Index (CI) values for some typical materials are:

| | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| ZSM-48 | 3.4 |
| TMA Offretite | 3.7 |
| Clinoptilolite | 3.4 |
| H-Zeolon (mordenite) | 0.4 |
| REY | 0.4 |
| Amorphous Silica-Alumina | 0.6 |
| Erionite | 38 |

REFINING OF LUBRICATING OILS

Refining suitable petroleum crude oils to obtain a variety of lubricating oils which function effectively in diverse environments has become a highly developed and complex art. Although the broad principles involved in refining are qualitatively understood, the art is encumbered by quantitative uncertainties which require considerable resort to empiricism in practical refining. Underlying these quantitative uncertainties is the complexity of the molecular constitution of lubricating oils. Because lubricating oils for the most part are based on petroleum fractions boiling above about 450° F., the molecular weight of the hydrocarbon constituents is high and these constituents display almost all conceivable structures and structure types. This complexity and its consequences are referred to in "Petroleum Refinery Engineering", by W. L. Nelson, McGraw Hill Book Company, Inc., New York, N.Y., 1958 (Fourth Edition), relevant portions of this text being incorporated herein by reference for background.

Usually in lubricant refining, a crude oil that contains a suitable fraction of lubricant stock, as judged by experience or assay, is selected for processing. The process of refining to isolate that lubricant stock consists of a set of subtractive unit operations which removes the unwanted components. The most important of these unit operations include distillation, solvent refining, and dewaxing, which basically are physical separation processes in the sense that if all the separated fractions were recombined one would reconstitute the crude oil.

A refined lubricant stock may be used as such as a lubricant, or it may be blended with another refined lubricant stock having somewhat different properties. Or, the refined lubricant stock, prior to use as a lubricant, may be compounded with one or more additives which function, for example, as antioxidants, extreme pressure additives, and V.I. improvers. As used herein, the term "stock", regardless whether or not the term is further qualified, will refer only to a hydrocarbon oil without additives. The term "raw stock" will be used herein to refer to a viscous distillate fraction of crude petroleum oil isolated by vacuum distillation of a reduced crude from atmospheric distillation, and before further processing, or its equivalent. The term "raffinate" will refer to an oil that has been solvent refined, for example with furfural. The term "dewaxed stock" or "dewaxed raffinate" will refer to an oil which has been treated by any method to remove or otherwise convert the wax contained therein and thereby reduce its pour point. The term "waxy", as used herein will refer to an oil of sufficient wax content to result in a pour point greater than +30° F. The term "stock", when unqualified, will be used herein generically to refer to the viscous fraction in any stage of refining, but in all cases free of additives.

Briefly, for the preparation of a high grade distillate lubricating oil stock, the current practice is to vacuum distill an atmospheric tower residuum from an appropriate crude oil as the first step. This step provides one or more raw stocks within the boiling range of about 450° to 1050° F. After preparation of a raw stock of suitable boiling range, it is extracted with a solvent, e.g., furfural, phenol, or chlorex, which is selective for aromatic hydrocarbons, and which removes undesirable components. The raffinate from solvent refining is then dewaxed, for example, by admixing with a solvent such as a blend of methyl ethyl ketone and toluene. The mixture is chilled to induce crystallization of the paraffin waxes which are then separated from the dewaxed dissolved raffinate in quantity sufficient to provide the desired pour point for the subsequently recovered raffinate.

Other processes such as hydrofinishing or clay percolation may be used if needed to reduce the nitrogen and sulfur content or improve the color of the lubricating oil stock, and to improve oxidation resistance.

When desired, hydrotreating may be used instead of, or in conjunction with, solvent refining to prepare the feedstock for the present invention.

The advantage of hydrotreating the feed before subjecting the lube oil stock precursor to catalytic dewaxing, is that many catalyst poisons will be either converted catalytically in the hydrotreater, or deposited on the hydrotreating catalyst. This results in superior operation in the catalytic dewaxing unit, and in a longer operational life.

Any conventional hydrotreating catalyst and processing conditions may be used.

Preferably the hydrotreating process uses a catalyst containing a hydrogenation component on a support, preferably a non-acidic support, e.g., Co-Mo or Ni-Mo on alumina.

The hydrotreater usually operates at relatively low temperatures, typically from 450° to 850° F., and preferably at temperatures of 600° to 750° F.

The hydrotreating catalyst may be disposed as a fixed, fluidized, or moving bed of catalyst, though down flow, fixed bed operation is preferred because of its simplicity. When the hydrotreating catalyst is disposed as a fixed bed of catalyst, the liquid hourly space velocity, or volume per hour of liquid feed measured at 60° F. per volume of catalyst will usually be in the range of about 0.1 to 10, and preferably about 1 to 5. In general higher space velocities or throughputs require higher temperature operation in the reactor to produce the same amount of hydrotreating.

The hydrotreating operation is enhanced by the presence of hydrogen, so typically hydrogen partial pressures of 10 to 150 atmospheres, preferably 30 to 100 atmospheres, absolute are employed. Hydrogen can be added to the feed on a once through basis, with the hydrotreater effluent being passed directly to the dewaxing zone.

Alternatively, and preferably, the hydrotreater effluent is cooled, and the hydrogen rich gas phase recycled to the hydrotreater. Cooling of hydrotreater effluent, and separation into vapor and liquid phases promotes removal of some of the nitrogen and sulfur impurities which would otherwise be passed into the catalytic dewaxing zone.

Other suitable hydrogenation components include one or more of the metals, or compounds thereof, selected from Groups II, III, IV, V, VIB, VIIB, VIII and mixtures thereof of the Periodic Table of the Elements. Preferred metals include molybdenum, tungsten, vanadium, chromium, cobalt, titanium, iron, nickel and mixtures thereof.

Usually the hydrotreating metal component will be present on a support in an amount equal to 0.1 to 20 weight percent of the support, with operation with 0.1 to 10 weight percent hydrogenation metal, on an elemental basis, giving good results.

The hydrogenation components are usually disposed on a support, preferably an amorphous support such as silica, alumina, silica-alumina, etc. Any other conventional support material may also be used. It is also possible to include on the support an acid acting component, such as an acid exchanged clay or a zeolite.

Preferably the support does not have much acidity, it is the intent of the present invention to primarily conduct hydrotreating in the hydrotreating zone and minimize cracking or other reactions therein. Preferably, the support has a low enough acid acting activity that the pour point of the lube oil stock passing through the hydrotreating zone is not changed at all, or is changed less than about 10° F. due to the hydrotreating process.

Viscosity index (V.I.) is a quality parameter of considerable importance for distillate lubricating oils to be used in automotive engines and aircraft engines which are subject to wide variations in temperature. This Index is a series of numbers ranging from 0 to 100 or higher which indicate the rate of change of viscosity with temperature. A viscosity index of 100 indicates an oil that does not tend to become viscous at low temperature or become thin at high temperatures. Measurement of the Saybolt Universal Viscosity of an oil at 100° and 210° F., and referral to correlations, provides a measure of the V.I. of the oil. For purposes of the present invention, whenever V.I. is referred to it is meant the V.I. as noted in the Viscosity Index tabulation of the ASTM (D567), published by ASTM, 1916 Race Street, Philadelphia 3, Pa., or equivalent.

To prepare high V.I. automotive and aircraft oils the refiner usually selects a crude oil relatively rich in paraffinic hydrocarbons, since experience has shown that crudes poor in paraffins, such as those commonly termed "naphthene-base" crudes yield little or no refined stock having a V.I. above about 40. (See Nelson, supra, pages 80–81 for classifications of crude oils). Suitable stocks for high V.I. oils, however, also contain substantial quantities of waxes which result in solvent-refined lubricating oil stocks of high pour point, i.e., a pour point substantially greater than +30° F. Thus, in general, the refining of crude oil to prepare acceptable high V.I. distillate stocks ordinarily includes dewaxing to reduce the pour point to not greater than +30° F. The refiner, in this step, often produces saleable paraffin wax by-product, thus in part defraying the high cost of the dewaxing step.

Raw distillate lubricating oil stocks usually do not have a particularly high V.I. However, solvent-refining, as with furfural for example, in addition to removing unstable and sludge-forming components from the crude distillate, also removes components which adversely affect the V.I. Thus, a solvent refined stock prior to dewaxing usually has a V.I. in excess of specifications.

The process of catalytic dewaxing of lubricating oils is described in U.S. Pat. Nos. 3,755,138 and 3,755,145, the entire contents of which are incorporated herein by reference.

In general, hydrodewaxing conditions include a temperature of about 450° to 750° F., pressures of 15 to 2000 psia, liquid hourly space velocities of 0.1 to 20, preferably 0.5 to 4, and hydrogen to hydrocarbon ratios of 500 to 5000 SCF/bbl.

Catalytic dewaxing may be conducted by passing the feed over a fixed, fluidized or moving bed of coked, large pore zeolite catalyst.

CATALYTIC DEWAXING TO IMPROVE POUR POINT

Catalytic dewaxing of high-pour gas oils to low-pour fuel oils over a shape selective zeolite catalyst such as ZSM-5 is described in U.S. Pat. No. 3,700,585 and its reissue, U.S. Pat. No. Re. 28,398, the entire contents of both of which are incorporated herein by reference.

A good general discussion of catalytic dewaxing to improve pour point is shown in Chen, N. Y. et al "New Process Cuts Pour Point of Distillates", Oil and Gas Journal, Vol. 75, No. 23, June 6, 1977, page 165 and Ireland et al "Distillate Dewaxing in Operation", Hydrocarbon Processing, May, 1979, the entire contents of which publications are incorporated herein by reference.

In very general terms, catalytic hydrodewaxing for pour point improvement operates with a fixed or moving bed of catalyst, although other types of catalyst beds such as ebulating bed, moving bed, fluidized bed, may also be used.

Catalytic dewaxing for pour point improvement usually requires somewhat higher temperatures than catalytic dewaxing to prepare a lubricating oil base stock, i.e., temperatures of 450° to 850° F., and preferably 500° to 800° F. are commonly used for catalytic dewaxing to improve pour point.

A certain amount of hydrogen partial pressure is essential, both to minimize coke formation and laydown on the catalyst, and also because hydrogen is consumed in cracking of normal paraffins to lighter molecules. Hydrogen is also helpful in promoting hydroisomerization of long chain paraffins or slightly branched paraffins to more highly branched paraffins.

Hydrogen partial pressures of 15 to 2000 psia give good results, while hydrogen partial pressures of 100 to 1000 psia give very good results.

The ratio of catalyst to oil, expressed as liquid hourly space velocity or volume per hour of normally liquid feed measured at 0° C. per volume of catalyst may range from about 0.1 to 10 hours$^{-1}$, preferably about 0.5 to 5 hours$^{-1}$.

The amount of hydrogen present may vary greatly, ranging from 500 to 5000 standard cubic feet per barrel of oil. It is possible to operate with even less hydrogen, although the catalyst will deactivate somewhat more quickly than if the preferred minimum amount of hydrogen, 500 SCFB, is added to the feed to the catalytic dewaxing zone. It is also possible to operate with even more hydrogen being present, however, it is expensive to circulate such large volumes of hydrogen through the reactor, and the small increase in catalyst life does not justify the expense of such high hydrogen circulation rates.

Hydrogenation/Dehydrogenation Component of Coked Zeolite

Preferably the zeolites contain, either before, during or after, coke deposition a catalytically effective amount of hydrogenation/dehydrogenation component. Suitable hydrogenation/dehydrogenation components may be selected from metal cations known to have hydrogenation/dehydrogenation activity including metal cations from Group IB, IIB, VIB, VII and VIII of the Periodic Table. Frequently mixtures of catalytically effective metals will be used. Accordingly, suitable hydrogenation/dehydrogenation components include nickel, molybdenum, cobalt, tungsten, nickel molybdenum, cobalt molybdenum, nickel tungsten, and platinum group metals, especially platinum and palladium.

It is preferable to remove from the zeolite, if any is present, alkali or alkaline earth metals which tend to reduce the acid activity of the zeolite.

Conventional methods can be used to remove alkali metals, and add hydrogenation/dehydrogenation components.

Catalysts of the present invention may contain from about 0.01 to about 30 wt. %, on an elemental metal basis of the hydrogenation/dehydrogenation components and preferably from about 0.1 to 15 wt. % hydrogenation/dehydrogenation metal component.

POROUS MATRIX

One embodiment of this invention resides in the use of a porous matrix to contain the large pore zeolites. The zeolites can be combined, dispersed or otherwise intimately admixed with a porous matrix in such proportions that the resulting product contains from 1% to about 95% by weight, and preferably from 10% to about 70% by weight of the zeolite in the final composite.

The term "porous matrix" includes inorganic compositions with which the aluminosilicates can be combined, dispersed or otherwise intimately admixed wheren the matrix may be active or inactive. It is to be understood that the porosity of the compositions employed as a matrix can either be inherent in the particular material or it can be introduced by mechanical or chemical means. Representative matrices which can be employed include metals and alloys thereof, sintered metals and sintered glass, asbestos, silicon carbide aggregates, pumice, firebrick, diatomaceous earths, alumina and inorganic oxides. Inorganic compositions especially those of a siliceous nature are preferred. Of these matrices, inorganic oxides such as clay, chemically treated clay, silica, alumina, and silica-alumina are highly advantageous.

Coking

Any coke precursors known to the art may be used as a source of coke or char for use in selective partial plugging of the large pore zeolites contemplated for use herein. Any of the coke forming materials mentioned in U.S. Pat. Nos. 4,097,543 or 4,231,899 may be used herein.

Preferably the coke sources are relatively clean material which will lead to relatively uniform coking. Relatively light hydrocarbons, such as normal butane through normal hexane and even heavier paraffins can be used, however, these materials are relatively valuable in themselves and are slow coke formers. Preferred coking materials are those commonly used as feedstock for carbon black plants, highly aromatic cycle oil. These materials are inexpensive, readily form coke, are easy to handle, and will give a relatively uniform coke distribution within the catalyst. Extremely heavy coke precursors, such as heavy asphaltic materials, are to be avoided because these are believed to be likely to plug up the external surface of the catalyst.

Preferably the coke source is relatively free of metals. Metals may be present in the coke precursors so long as they will have no deleterious effect on the catalytic dewaxing process. It may even be beneficial, in some circumstances, to combine coke deposition with all, or a portion, of the incorporation of the hydrogenation/-dehydrogenation component into the zeolite. Usually it is preferred to conduct these separately so that it is possible to independently vary the metals loading on the zeolite and the coke loading.

Preferably the coking is conducted relatively rapidly, in an atmosphere conducive to coke formation. Typical conditions experienced within a hydrocracker or catalytically dewaxing unit, including high hydrogen partial pressures, are not conducive to coke formation. Low or no hydrogen partial pressure significantly augment coke deposition on the large pore zeolites used in the process of the present invention.

Preferably coking occurs in a neutral or mildly reducing atmosphere. Such an atmosphere is conducive to coke lay down. One way in which such an atmosphere may be achieved, and the necessary coking temperatures achieved, is to pass the coke precursor and neutral or mildly reducing gas at an elevated temperature over the large pore zeolites.

Coke deposition conditions include any conditions of temperature and reaction time which have been sufficient to produce coke in prior art processes. Relatively large extremes of temperature may be used, the minimum temperature being that which will promote coke deposition on the zeolite. The maximum temperature is usually set by the maximum temperature that the zeolite can stand before losing an unacceptable amount of crystallinity or surface area. Equipment limitations may also set a practical maximum of temperature limit.

Ranges of coking conditions are set forth in the following table:

| Coking Condition | Broad | Preferred |
|---|---|---|
| Coke, wt % | 10–60 | 15–30 |
| WHSV of coking agent | 0.1–100 | 0.5–10 |
| Temperature, °C. | 100–1000 | 300–700 |
| Time, hours | 0.1–2000 | 1–100 |
| Pressure kPa | any | 1–100 |

It is perhaps theoretically possible to have some coke deposition at a relatively low temperature by passing a severely visbroken heavy stock at a temperature of 100°–200° C. over the zeolite. It is also possible to load the zeolite with a coke precursor at a low temperature, and then convert the coke precursor to coke at a higher temperature.

Usually coke deposition can be conveniently accomplished at temperatures of 300°–700° C. by passing coke precursor over a fixed, fluidized, or moving bed of the zeolite. Batch contacting of coke precursor and zeolite is also possible.

The contact time of coke precursor and zeolite can vary greatly. When extremely severe coking conditions are used, it may be possible to deposit the necessary amount of coke in one second or less. There is no harm in very slowly depositing the coke over a period of several days or more.

EXAMPLES

The following examples illustrate the inherent, but heretofore unrecognized, beneficial effect of coke deposition. The coking effect is inherent in normal hydrocracking operations, but it takes a long time for coke levels to increase sufficiently to make the large pore shape selective. The catalyst properties of the catalyst, labelled Catalyst A for convenience, are reported hereafter.

Catalyst A consists of 4% Ni and 10% W on a base of 50% amorphous $SiO_2$/alumina (13% $Al_2O_3$) and 50% REX zeolite. The catalyst was presulfided prior to use.

Catalyst A was then tested for hydrocracking of two charge stocks. Heavy Vacuum Gas Oil (HVGO) containing 2.45% S and 600 ppm N was fed for about 40 days, then the feed was changed to hydrotreated vacuum gas oil, HDT.

The initial selectivity of Catalyst A, after 10 days on stream, is characteristic of large-pore zeolite and amorphous catalysts. There was a modest reduction in pour point of the 650° F.+bottoms material. The charge pour point of 95° F. was reduced to 70° F. Selectivity for G+D (gasoline plus distillate), was initially about 83%, and gas makes were moderate. Aromatics were preferentially converted, resulting in a concentration of paraffins remaining in the 650° F.+ product.

After (nearly) 40 days on stream, the selectivity for G+D of the catalyst decreased to about 63% and gas makes increased correspondingly. The conversion of paraffins increased relative to total ring structures, suggesting that the catalyst had become more shape-selective. Although total ring structures remaining in the 650°F.+ product increased, the conversion of aromatics indicates that the hydrogenation component of the catalyst remained active.

After 40 days on stream, the feed was changed to a hydrotreated HVGO containing 0.15% sulfur and 200 ppm nitrogen. The activity of the catalyst improved considerably. However, the shape-selective behavior remained. Again, conversion of paraffins resulted in a low pour point (−15° F.) 650° F.+ product. The end-point remained high indicating shape-selective exclusion of the highest boiling components in the charge. The low distillate yield and high gas are also characteristic of shape-selective conversion.

Experimental results are presented in the following Table 1.

TABLE 1

| Hydrocracking With Catalyst A | | | | | |
|---|---|---|---|---|---|
| | HVGO | | | HDT | |
| Days on Stream | Charge | 10.1 | 38.4 | Charge | 44.1 |
| Temperature °F. | — | 776 | 781 | — | 781 |
| LHSV | — | 0.69 | 0.59 | — | 1.05 |
| Dry Gas + Butanes | — | 12.9 | 28.5 | | 30.9 |
| $C_5$-330° F. Naphtha | — | 39.1 | 37.2 | | 24.7 |
| 330–650° F. Distillate | 5 | 27.5 | 11.2 | 5 | 4.4 |
| 650° F. + Bottoms | 95 | 20.2 | 23.6 | 95 | 42.4 |
| 650° F. + Pour Point, °F. | 105 | 70 | 45 | 110 | −15 |
| 650° F. + 95% TBP, °F. | 1026 | 915 | 951 | 1008 | 991 |
| 650° F. + Paraffins | 24 | 56 | 32 | 28 | 17 |
| 650° F. + Aromatics | 51 | 12 | 24 | 44 | 24 |

This experiment shows that it is possible, by coke deposition on a large pore zeolite, REX in an amorphous $SiO_2.Al_2O_3$ base, to make the catalyst simulate a shape selective zeolite.

The shape selective catalyst produced by natural catalyst aging is not, however, covered by the claims of the present invention which require that coke deposition occur rapidly or at a relatively low hydrogen partial pressure.

The advantage of our coke deposition process is that it is unnecessary to operate a plant for more than a month, as was necessary in the Example, to obtain shape selectivity. This has many advantages in that it is also not necessary to design a plant which can accommodate tremendous increases and decreases of various product streams. It is very difficult to design distillation columns which can tolerate more than 5 to 1 swings in volume of certain product streams. The operation after 10 days on stream produced 27.5 pounds of 330°–650° F. distillate per hundred pounds of feed, whereas the shape selective material produced only 4.4 pounds of this distillate. The feeds were not identical, nor were the process conditions, but the changes in distillate production far exceed those that would be due to any changes in operating conditions or feedstocks. Similarly, the amount of dry gas production increased about two and a half fold when comparing the shape selective zeolite (44.1 days of operation) to conventional operation (10.1 days of operation).

BEST MODE

If we were building a plant to accomplish shape selective dewaxing using a coke modified large pore zeolite, we would use about the same catalyst and process conditions used in the examples. We would speed up the coking of the zeolite so that the desird minimum coke content, of around 10 to 15 wt. % coke, could be achieved relatively quickly. Operating the unit at about half of its normal operating pressure would significantly speed up the coke buildup. After the desired amount of coke on catalyst had been obtained, pressure could be gradually, or abruptly, increased to normal operating pressure.

We claim:

1. A process for dewaxing a wax containing hydrocarbon oil feedstock comprising providing a coked zeolite containing catalyst, wherein said coked zeolite contains 10 to 60 weight percent coke, wherein the zeolite, prior to being coked, has a constraint index less than 1, wherein the zeolite is subjected to coking with a coke precursor at coking conditions including a neutral or reducing atmosphere where the hydrogen partial pressure of said reducing atmosphere is less than about 20 atmospheres absolute, to effect relatively uniform coke distribution to restrict the pore size of the zeolite without plugging up the external surface and without unacceptably decreasing the surface area thereof and contacting said feedstock with said catalyst in the presence of hydrogen at hydrodewaxing conditions to selectively dewax said feedstock.

2. Process of claim 1 wherein said catalyst contains a hydrogenation/dehydrogenation component selected from Group VI, VII and VIII metals of the Periodic Table and mixtures thereof.

3. Process of claim 2 wherein said zeolite contains 0.1 to 20 wt. % hydrogenation/dehydrogenation component, on an elemental metal basis.

4. Process of claim 1 wherein said feed is a petroleum fuel oil.

5. Process of claim 1 wherein said feed is a lubricating oil base stock.

6. The process of claim 1, wherein said zeolite is selected from the group of X, Y, ZSM-3, ZSM-20 and Beta.

7. The process of claim 1, wherein dewaxing is conducted at a hydrogen partial pressure in excess of the hydrogen partial pressure of said reducing atmosphere.

8. The process of claim 1, wherein said coke is deposited on said zeolite within about 0.1 to 100 hours.

9. The process of claim 6 wherein said catalyst contains 0.1 to 20 weight percent of a hydrogenation/dehydrogenation component on an elemental basis.

10. The process of claim 6 wherein said feed is a petroleum fuel oil.

11. The process of claim 6 wherein said feed is a lubricating oil base stock.

12. The process of claim 6, wherein said coke is deposited in said zeolite within about 0.1 to 100 hours.

13. The process of claim 1, wherein said zeolite contains 15 to 30 weight percent coke.

14. The process of claim 6, wherein said zeolite contains 15 to 30 weight percent coke.

* * * * *